US005867866A

United States Patent [19]

Chen et al.

[11] Patent Number: 5,867,866

[45] Date of Patent: Feb. 9, 1999

[54] DOOR HINGE WITH A BUILT-IN DAMPER

[76] Inventors: Zheng Chen, 1662 Hollenbeck Ave. Apt. 2, Sunnyvale, Calif. 94087; Shangda Chen, Zibo Coal Mine Headquarter, Building 5, Room 10, Hongshan, Shandong, China

[21] Appl. No.: 950,161

[22] Filed: Oct. 15, 1997

[51] Int. Cl.[6] ..... E05F 3/20

[52] U.S. Cl. ..... 16/50; 16/54

[58] Field of Search ..... 16/50, 54, 71, 16/72, 75, 76, 303–305, 308, 341, 342, 319

[56] References Cited

U.S. PATENT DOCUMENTS

| | | | |
|---|---|---|---|
| 685,403 | 10/1901 | Hughes | 16/54 |
| 1,134,510 | 4/1915 | Busch | 16/54 |
| 1,176,014 | 3/1916 | Wyeth et al. | 16/54 |
| 1,701,022 | 2/1929 | Thornton | 16/54 |
| 2,490,258 | 12/1949 | Diebel | 16/54 |
| 4,756,051 | 7/1988 | Shy | 16/54 |
| 4,829,628 | 5/1989 | Vuksic | 16/54 |
| 5,090,521 | 2/1992 | Miura | 16/54 |

*Primary Examiner*—Chuck Y. Mah

[57] ABSTRACT

A door hinge assembly with a damper mechanism composing a cylindrical housing with caps on both ends, a shaft eccentrically mounted on the cylindrical body, and two plates mounted on the shaft. Two chambers are constructed with the above arrangement and both chambers are filled with oil-hydraulic fluid. When the shaft rotates with respective to the cylindrical body, one of the two chambers is compressed. With means of communicating the two chambers, a desirable dampening force is obtained. Bias spring(s) can be incorporated into this door hinge assembly to provide closing force, so this assembly functions as a door closer.

8 Claims, 4 Drawing Sheets

22a
24a
48

DOOR HINGE WITH A BUILT-IN DAMPER

BACKGROUND

1. Field of Invention

This invention relates to a door hinge with a dampening force when the door is closing, or opening, or both.

BACKGROUND

2. Description of the Prior Art

A dampening force is most desirable in opening and closing a door. Although a separate device can be used to provide such a dampening force, it is advantageous to incorporate this functionality into the door hinges for numerous reasons such as aesthetics, safety, cost, etc. Hydraulic damped hinges have an advantage due to their smoothness in operation and ability in adjusting dampening force. Two types of such devices are known in prior arts: 1) incorporate a piston-cylinder mechanism into the hinge, U.S. Pat. No. 4,829,628 to Zeljko B. Vuksic (1989); and 2) incorporate a leaf-compartment mechanism into the hinge, China patent 2074353 (1991). The hydraulic fluid inside the assembly is compressed when the door closes thus generating a braking force.

All the above mentioned devices have severe disadvantages. In a piston-cylinder mechanism, the device becomes fairly complicated. Due to limited motion of the door, say 90° from close to open, the travel distance of the piston is greatly limited. Either a relatively high level of precision in manufacturing is required, or a relatively large size of the hinge is required in order to achieve desired functionality. For the leaf-compartment mechanism, a divider needs to be inserted into and anchored onto the cylinder body. This increase the manufacture complexity greatly as well as the cost. It also limits the angle of operation due to these dividers.

OBJECTS OF THE INVENTION

An object of the invention is to provide a simple, compact, and inexpensive door hinge with a dampening force.

Another object of the invention is to provide a door closer, which can smoothly and effectively close the door after opened and released.

A further object of the invention is to provide a means to hold a door in its current position until a sufficient force is applied to the door.

An additional object of the invention is to provide a means to prevent a door from rapid opening or closing so as to protect the door, doorframe, or surroundings from being damaged.

| Reference of numerals in drawings | |
|---|---|
| Cylindrical body | 10 |
| Shaft | 20 |
| Plates | 22, 24 |
| Plate guides | 26, 28 |
| Plate spring | 25 |
| Bias spring | 30 |
| End caps | 34, 36 |
| One way valve | 40 |
| Adjustable one way valve | 42 |
| Vale spring | 44 |
| Adjusting screw | 46 |
| Rod | 48 |

BRIEF DESCRIPTION OF THE DRAWINGS

The preferred embodiments of this invention will be described in details in conjunction with the drawings, wherein.

SUMMARY

Figure 1:
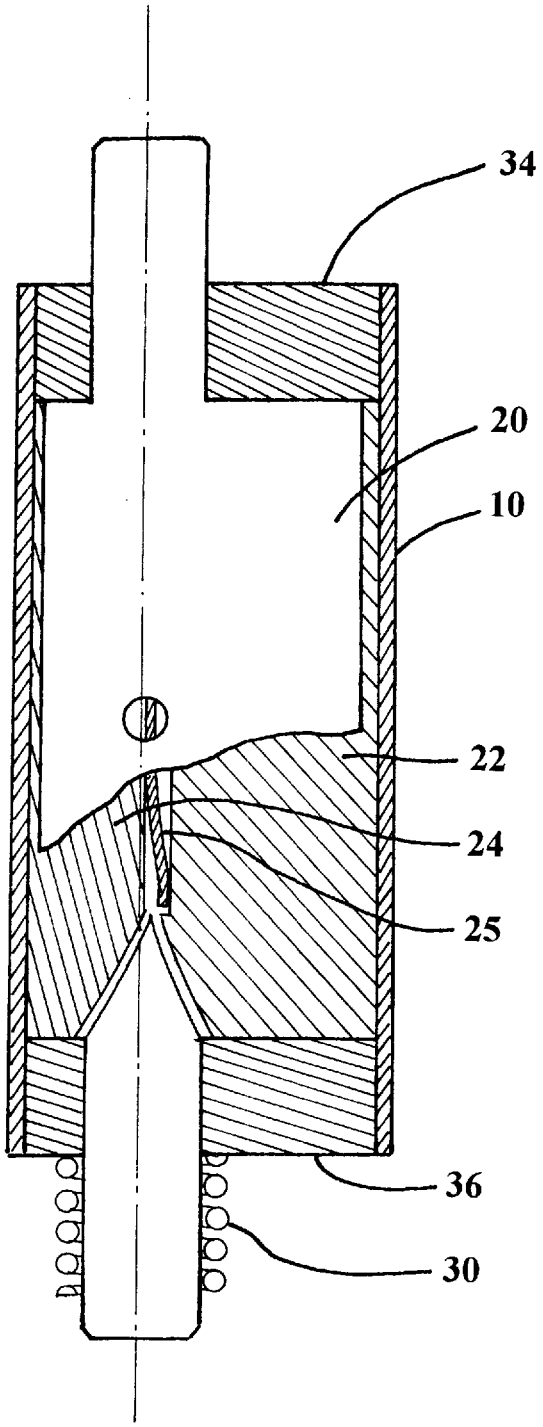
FIG. 1 is a longitudinal section view of the damped hinge assembly in the preferred embodiment as a door closer.

The present invention provides a door hinge assembly which has means to exert a dampening force when the door is closing, opening, or both, with a simple structure for ease of manufacturing with minimal cost. Said assembly comprises of one cylindrical body, two end caps attached to both ends of said cylindrical body, a shaft passing through said cylindrical body and said caps with certain eccentricity, two cuts on the body of said shaft acting as guides, two leafs which can move freely in and out of said guides and across the inner wall of said cylindrical body, spring means to push said leafs toward the inner wall of said cylindrical body therein forming two compartments within said cylindrical body, and passages to communicate between the two compartments. Said cylindrical body and shaft are to be secured to the door and door frame either through anchor plates or flanges.

DETAILED DESCRIPTION OF PREFERRED EMBODIMENTS

The device in accordance with the present invention as illustrated in the drawings as a door closer has a cylindrical body 10, which is secured onto one of the anchor plates (not shown). A shaft 20, which is secured onto the other anchor plate (not shown), passes through the cylindrical body with its axis parallel to that of cylindrical body. Two plate guides 26 and 28 are on the opposite elongated sides of the center part of the shaft holding two plates 22 and 24 therein, which can move freely in and out of the plate guides. A plate spring 25 is inserted inside the shaft and between the two plates. It pushes the edges of the two plates toward the inner wall of the cylindrical body. Two end caps 34 and 36 are attached to both ends of the cylindrical body respectively and have bores to let the shaft pass through and rotate therein. The axis of shaft 20 does not coincident with that of the cylindrical body, but with a certain eccentricity. A one-way valve 40 is on the shaft and an adjustable one-way valve 42 is on end cap 36. A bias spring 30 provides the closing force. Hydraulic fluid is filled and sealed inside the device. Movement of the associated door rotates shaft 20 with respect to cylindrical body 10 in a well-known manner.

Figure 2:
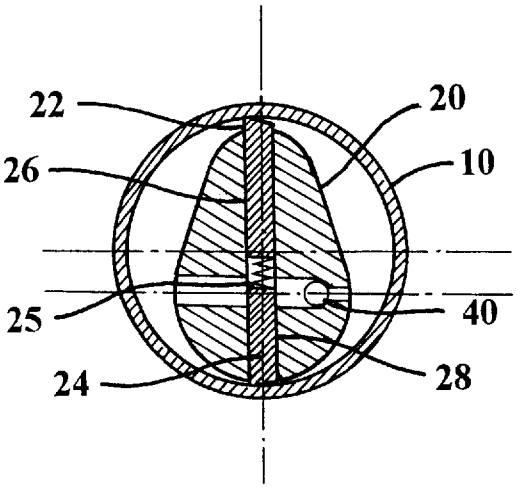
FIG. 2 is a cross section view of the damped hinge assembly in the preferred embodiment as a door closer. The embodiment is arranged in such a way that when the associated door opens, said shaft rotates clockwise.

Two chambers A and B are formed with cylindrical body 10, shaft 20, plates 22 and 24, and end caps 34 and 36, as shown in FIGS. 1 and 2. The inner wall of the cylindrical body is in close contact with the edges of the two plates due to the plate spring 25. The end caps are in close contact with the edges of the two plates, therefore only a very small amount of fluid can flow through these contact even when the pressure on one side is significantly greater than that on the other side. When shaft 20 rotates with respect to the cylindrical body, the outer corner of plate guides 26 and 28 are in close contact with the surfaces of plate 22 and 24. At the same time, the edges of plate 22 and 24 are in close contact with the walls of the plate guides. The fluid can not flow easily from one chamber to the other without going through the two one-way valves.

Figure 3:
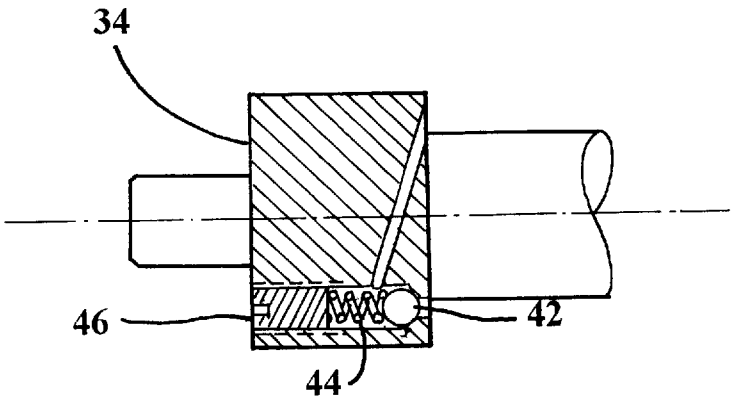
FIG. 3 is a longitudinal section view of the end cap with an adjustable one-way valve. Hydraulic fluid will flowthrough the valve when the pressure is greater than a predetermined value.

One-way valve 40, which is on the body of the shaft, allows fluid to flow freely from chamber B to chamber A. Adjustable one-way valve 42, which is on end cap 36 as shown in FIG. 3, allows fluid in chamber A to flow to chamber B only when the pressure difference between the two chambers is greater than a certain value, called threshold pressure. This threshold pressure is determined by the compression of a valve spring 44, which can be adjusted by rotating an adjusting screw 46.

When the associated door is opened, shaft 20 rotates clockwise with respect to cylindrical body 10. Plates 22 and 24, while rotating together with the shaft, move in or out of the plate guides 26 and 28 depending on the position of the shaft relative to that of the cylindrical body keeping chamber A and chamber B separated. The volume of chamber B decreases while that of chamber A increases. Fluid in chamber B is compressed and then flows through one-way valve 40 to chamber A. Bias spring 30 is now loaded storing a closing force.

When the associated door is released, the restoring force stored in bias spring 30 forces the door to rotate shaft 20 counterclockwise to the close position of the door. In this situation, the volume of chamber A decreases while that of chamber B increases. One-way valve 40 is closed so the fluid in chamber A can not flow through this valve to chamber B. Adjustable one-valve 42 will not open unless the pressure in chamber A increases to a certain value. Only a very small amount of fluid can leak through the contacts between the plates and guides on the shaft, between the plates and the inner wall of the cylindrical body, and between the plates and the end caps. Therefore, the fluid in chamber A is compressed increasing the pressure therein. This compression provides a dampening force for closing the door. By adjusting screw 46, the threshold pressure in chamber A can be adjusted, therefore the dampening force or the closing speed of the associated door can be adjusted to a desirable value.

Figures 4A, 4B, 4C, 4D:
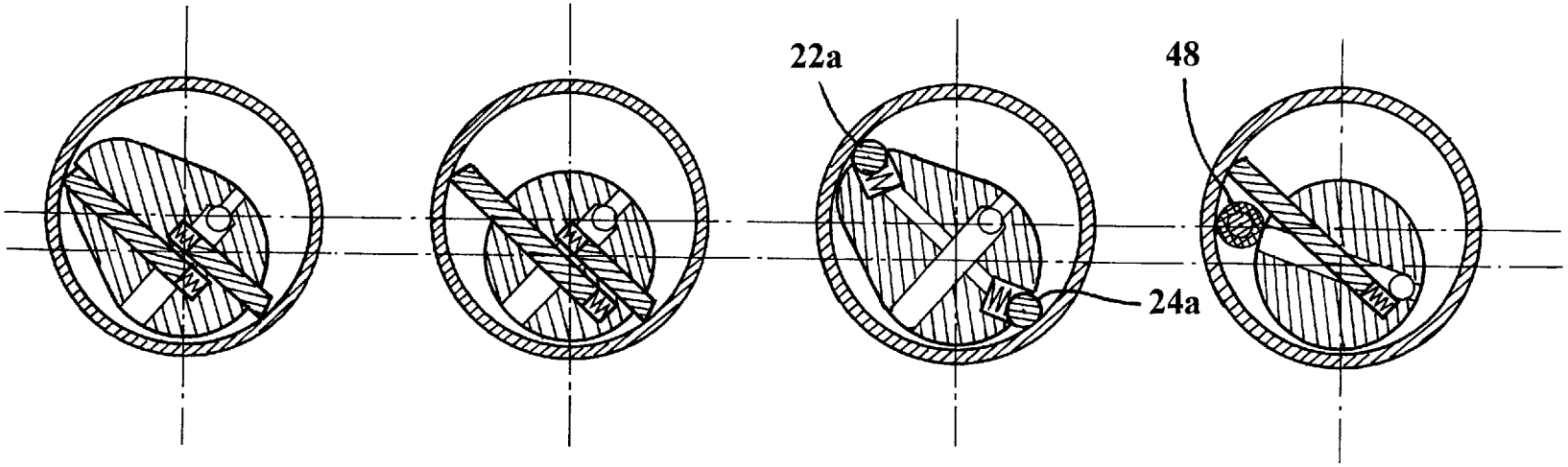
FIGS. 4*a* through 4*d* show various arrangements and configurations of the shaft and leafs.

Additional embodiments of the present invention are shown in FIGS. 4*a* to 4*d*. The two plates do not have to be back to back. Instead, they can be shifted a certain distance, as shown in FIG. 4*a*. It is not necessary to make the middle part of the shaft elongated. The advantage of doing that is an improved stability. FIG. 4*b* shows a shaft with a circular cross-section in the middle and the two plates shifted by a certain distance. One can also replace the plates with rods, as shown in FIG. 4*c*, 22*a* and 24*a*. The two plates can even be replaced by one plate with means to construct two chambers. In FIG. 4*d*, a rod 48, which has soft material on its surface, and a plate are used to construct two chambers. Rod 48 is in close contact with the cylinder wall and with the shaft, which has a circular cross section in the middle part.

In the embodiments of the present invention, parts can be rearranged according to factors such as manufacturing, weight, strength, etc. For example, one-way valve 40 which allows fluid to flow from chamber B to chamber A may be located on one of the end caps, instead of on the shaft. In the description of preferred embodiment, a desired closing rate is achieved by adjusting screw 46. This can also be achieved by fixing the critical pressure but varying the strength of bias spring 30. The bias spring can even be located outside the assembly.

Although the present invention is described in the preferred embodiment as a door closer, with slight modifications this invention can achieve functionality other than a door closer. One example is a door position holder, which holds the position of a door until the door is pushed or pulled. In this case, bias spring 30 and one-way valve 40 are removed, and an adjustable two-way valve replaces adjustable one-way valve 42. Fluid can only flow through this valve and it will flow from one chamber to the other whenever the pressure in one chamber is greater than the other by a certain value, except for a very small amount leaking through the contacts. This device will also protect a door from rapid opening or closing, such as excessive force or strong wind.

We claim:

1. A hinge assembly containing damper means comprising:

a body of cylindrical shape having a first end cap with a bore fixed onto one end and a second end cap with a bore fixed onto the opposite end;

a shaft passing through said cylindrical body and pivotably mounted on to said bores of said first end cap and said second end cap; the axis of said shaft is parallel to that of said cylindrical body and is shifted a certain distance from that of said cylindrical body;

dividing means associated with said cylindrical body, said shaft, said first end cap, and said second end cap for defining a first chamber and a second chamber, both chambers being filled with hydraulic fluid;

valve means for communicating between said first chamber and said second chamber.

2. The hinge assembly of claim 1, wherein said dividing means comprising:

a first elongated member and a second elongated member slidably mounted along and on the opposite side of said shaft;

spring means for pressing the side of said first elongated member and the side of said second elongated member in close contact with the inner wall of said cylindrical body.

3. The hinge assembly of claim 2, wherein said elongated members are plates.

4. The hinge assembly of claim 1, wherein said valve means comprising a first one-way valve and a second one-way valve connecting said two chambers, said first one-way valve allowing fluid to flow from one of said chambers to the other, said second one-way valve only allowing fluid to flow through when pressure difference between said two chambers is greater than a predetermined value;

whereby said shaft can rotate freely a predetermined direction with respect to said cylindrical body while requires a sufficient force to rotate in the opposite direction with respect to said cylindrical body.

5. The hinge assembly of claim 4, wherein said second one-way valve contains means for adjusting the pressure difference between said two chambers at which said second valve will open.

6. The hinge assembly of claim 4, further comprising a restoring force means for storing a restoring force when said shaft rotates in said predetermined direction with respect to said cylindrical body.

7. The hinge assembly of claim 1, wherein said valve means comprising a valve connecting said two chambers, said valve allowing fluid to flow through either direction when the pressure difference between said two chambers is greater than a predetermined value; whereby said shaft requires a sufficient force to rotate in either direction with respect to said cylindrical body.

8. The hinge assembly of claim 7, wherein said valve contains means for adjusting the pressure difference between said two chambers at which said valve will open.

* * * * *